US007444771B2

(12) United States Patent
Raccah

(10) Patent No.: US 7,444,771 B2
(45) Date of Patent: Nov. 4, 2008

(54) DISPLAY DEVICE FOR USE WITH VEHICLE

(76) Inventor: Enrico Raccah, 6401 SW. 107 St., Miami, FL (US) 33156

( * ) Notice: Subject to any disclaimer, the term of this patent is extended or adjusted under 35 U.S.C. 154(b) by 0 days.

(21) Appl. No.: 11/727,237

(22) Filed: Mar. 26, 2007

(65) Prior Publication Data

US 2008/0236003 A1 Oct. 2, 2008

(51) Int. Cl.
*G09F 11/18* (2006.01)

(52) U.S. Cl. ..... 40/466; 40/484; 40/482; 40/483; 40/471

(58) Field of Classification Search ..... 40/42, 40/482, 483, 484, 466, 467, 471, 491
See application file for complete search history.

(56) References Cited

U.S. PATENT DOCUMENTS

| | | | | |
|---|---|---|---|---|
| 505,682 | A | 9/1893 | Stone | |
| 623,641 | A | 4/1899 | Warrick | |
| 676,821 | A | 6/1901 | Neumayer | |
| 1,350,244 | A * | 8/1920 | Siegel | 40/483 |
| 1,973,276 | A * | 9/1934 | Bard | 40/591 |
| 3,802,103 | A | 4/1974 | Neff | |
| 5,412,892 | A * | 5/1995 | Filippakis | 40/471 |
| 5,440,214 | A * | 8/1995 | Peeters | 318/685 |
| 5,809,677 | A * | 9/1998 | Wamser et al. | 40/471 |
| 5,953,840 | A * | 9/1999 | Simson et al. | 40/471 |
| 6,236,330 | B1 | 5/2001 | Cohen | |
| 6,467,207 | B1 * | 10/2002 | Jones et al. | 40/471 |
| 6,691,441 | B1 * | 2/2004 | Crivelli et al. | 40/471 |
| 2004/0025391 | A1 | 2/2004 | Storm | |
| 2004/0103571 | A1 | 6/2004 | Smith | |

* cited by examiner

*Primary Examiner*—Lesley D. Morris
*Assistant Examiner*—Shin Kim
(74) *Attorney, Agent, or Firm*—Hoffman, Wasson & Gitler

(57) ABSTRACT

A device for continuously or intermittently displaying graphic material, such as advertisements on the side or rear of a moving vehicle. The vehicle is provided with various sensors which determine the speed of the vehicle as well as whether the vehicle has been parked for a predetermined period of time. Based upon the output of the sensors, the movement of scrolled display containing graphics such as advertisements would be controlled.

20 Claims, 4 Drawing Sheets

DISPLAY DEVICE FOR USE WITH VEHICLE

FIELD OF THE INVENTION

The present invention is directed to a system for providing a moving sign on the side or rear of a motor vehicle.

BACKGROUND OF THE INVENTION

There is no doubt that the previous 100 years has changed the manner in which individuals travel from one place to another. Early in the $20^{th}$ century, most individuals remained close to where they worked and lived. Motor vehicles were rare and most people traveled in a limited area using horse drawn carriages. The advent of the use of internal combustion engines to power vehicles, allowed individuals to live further from their place of employment as well as to travel more extensively. Additionally, the advent of the internal combustion engine changed the manner in which goods were transported from one place to another. Increasingly, the use of large commercial trucks has supplanted railroads as the main manner in which goods are transported from one location to a second location. It is obvious that one of the reasons for this transformation is the fact that railroads are constricted to the routes they may travel, whereas large commercial vehicles would use the myriad number of highways to travel from one location to a second, remote location.

Initially, the rather large side and rear surfaces of these commercial vehicles were devoid of any indicia, save perhaps the name of the transport company. Recently, the owners of these transport companies have realized that advertising on the side of these vehicles would act as another source of revenue. Although roadside billboards have long been in use, the immobility of this advertising venue often limited its effectiveness. Recently, advertisements have been directly affixed to the sides and rear of commercial vehicles, allowing the advertisement to traverse the nation's highways while goods provided therein were shipped to their final destination. Additionally, the routes of these vehicles would not only be mandated based upon a route taken to deliver the goods, the route itself could be used to more effectively advertise particular goods or services.

Recently, static advertisements provided on the sides of commercial or other vehicles has been introduced to provide a better way of advertising a product. For example, U.S. Pat. No. 5,412,892, issued to Filippakis, discloses a scrolling display sign used for vehicles, such as a taxi cab illustrated in FIG. 1. The display sign includes an automatic timer delay means for the intermittent stopping of the message for viewing, and the automatic scrolling of the message to display a subsequent message after a given elapsed period of time. An intermittent timer device is connected to motorized reels in order to provide for the advance of a strip to display a new message or design. The intermittent timer device provides for the adjustability of a pause time, allowing viewers to read or absorb the message displayed on the display sign.

U.S. Pat. No. 6,691,441, issued to Crivelli et al, discloses a device for displaying a set of various flexible posters. A programmable control assembly sends signals to a set of motors so that varying display cycles for different posters can be maintained. Each poster can be assigned a frequency and display time which can be modified over time. The entire device can be placed on a vehicle, such as illustrated in FIG. 9.

U.S. Pat. No. 5,440,214, issued to Peeters, discloses a drive control and interface apparatus for an advertising display. The apparatus includes a microprocessor having a programmed memory connected to a motor for changing the image displayed after a corresponding predetermined period of time.

U.S. Pat. No. 6,236,330, issued to Cohen, discusses a mobile display system comprising an externally viewable display panel and a programmable controller. The controller ascertains the display location and generates a publicly viewable message pursuant to a schedule which includes a date, time of day and display duration.

While the above-listed U.S. patents describe systems for providing a movable sign attached to a vehicle, none of these references describe a system in which the movement of the vehicle would determine, at least in part, the manner in which a movable advertisement would scroll across the side or rear of the vehicle.

SUMMARY OF THE INVENTION

The deficiencies of the prior art are addressed by the present invention which is directed to a system for presenting one or more panels of printed information at variable time intervals while attached to a moving vehicle. The panels are placed back-to-back on a roll that advances forward, or backward, displaying the panels sequentially. A programmed electronic microprocessor would control a set of motors, gears and bars that allow the panels to advance. The microprocessor can change the panels automatically at predefined and variable time intervals. Additionally, various sensors associated with the moving vehicle would alter the manner in which the printed panels, having advertisement or other indicia thereon, would advance based upon the movement of the vehicle. For example, if it is sensed that the vehicle is moving above a certain speed, it will be assumed that that vehicle is traveling on a highway or similar high speed thoroughfares. If this occurs, the movement of the panels would be discontinued until it was sensed that the vehicle was traveling in a city setting. Furthermore, if the vehicle is parked for more than a predetermined period of time. A decision would be made whether to suspend the movement of the panels.

BRIEF DESCRIPTION OF THE DRAWINGS

The foregoing aspects and other features of the invention are explained in the following description taken in connection with the accompanying drawings wherein.

DETAILED DESCRIPTION OF THE INVENTION

Figure 1:
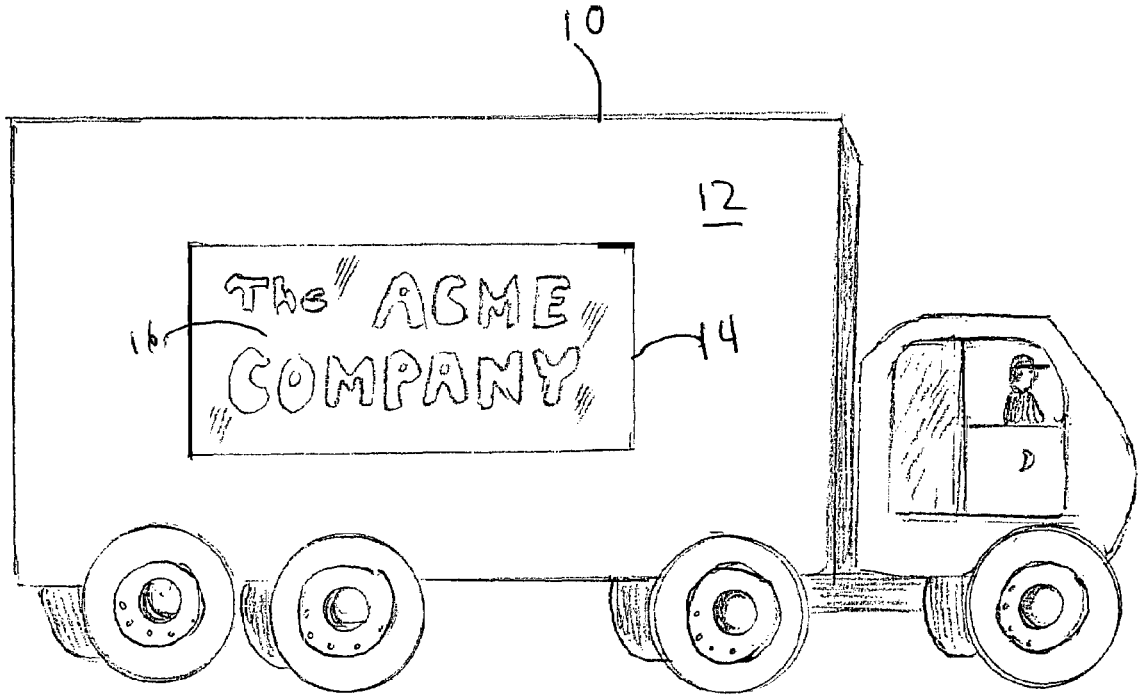
FIG. 1 is a side view of a truck having the scrolling sign housing mounted on a side panel.

FIG. 1 shows a moving vehicle 10 such as a truck onto which a scrolling sign housing 14 is to be affixed. Although the sign is shown to be affixed to a side panel 12 of the moving vehicle, obviously it could also be attached to the rear portion of the vehicle. Generally speaking, the scrolling sign housing 14 would generally be fixedly or removably attached to the moving vehicle. The scrolling sign housing 14 would include an advertisement 16 or other indicia which is designed to intermittently or continuously scroll across the front of the scrolling sign housing 14. Although FIG. 1 illustrates the present invention affixed to a truck, any moving vehicle, such as a tractor trailer, a taxi, an SUV or any other type of moving vehicle could be utilized.

Figure 2:
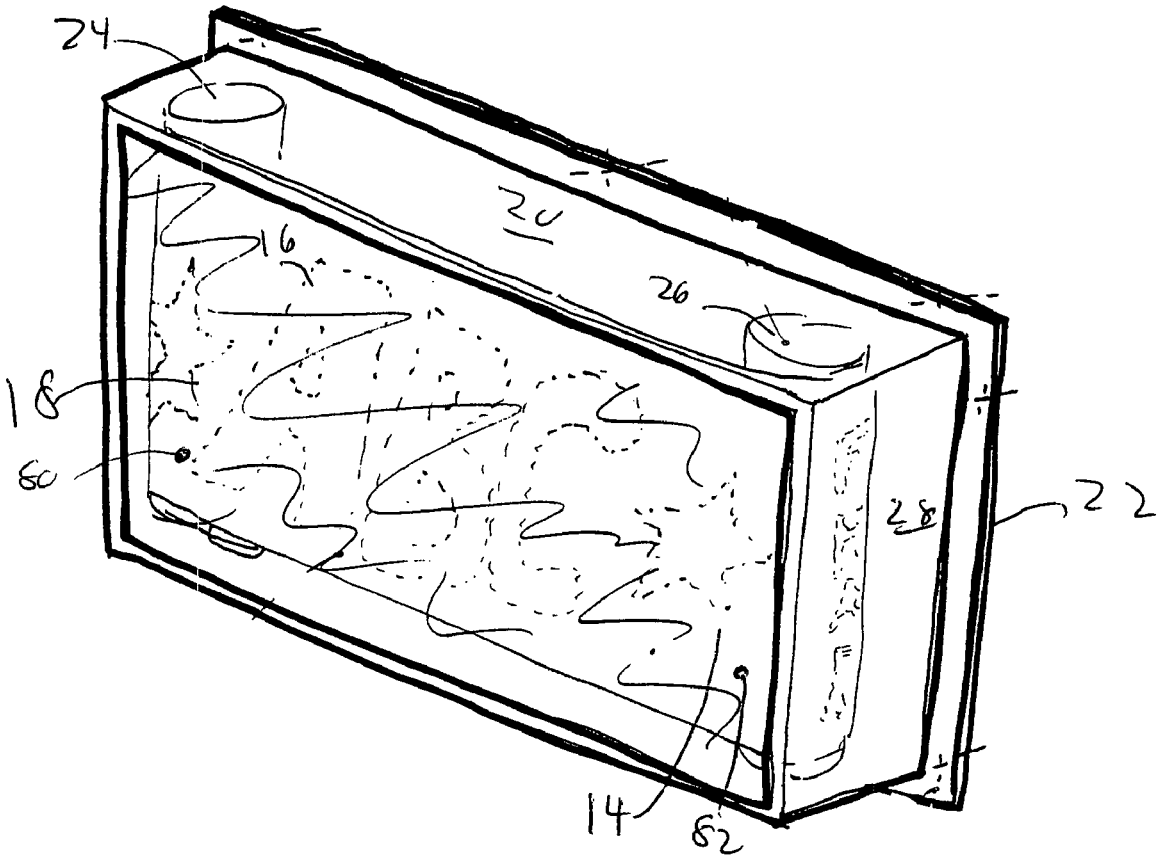
FIG. 2 is a perspective view of the scrolling sign housing according to the present invention.

FIG. 2 illustrates a perspective view of the scrolling sign housing to be affixed to the moving vehicle 10. The scrolling sign housing 14 would generally consist of a closed compartment formed by a top 20, a bottom (not shown) as well as left and right sides 28. At least the front surface 18 of the scrolling sign housing 14 would be constructed from a transparent panel allowing the advertisement 16 to be displayed therethrough. The entire scrolling sign housing 14 is applied to a mounting panel 22 which in turn is fixedly or removably attached to the sides or rear of the moving vehicle. The advertising material or other indicia 16 is applied to a single panel or a plurality of panels capable of being moved in a forward or rear direction in back of the transparent panel 18 by the use of one or more rotating tubes 22, 24. As will be explained, the manner in which the advertisement material or indicia 16 moves behind the transparent panel 18 would be determined, at least in part, based upon the sensed movement of the vehicle.

Figure 3:
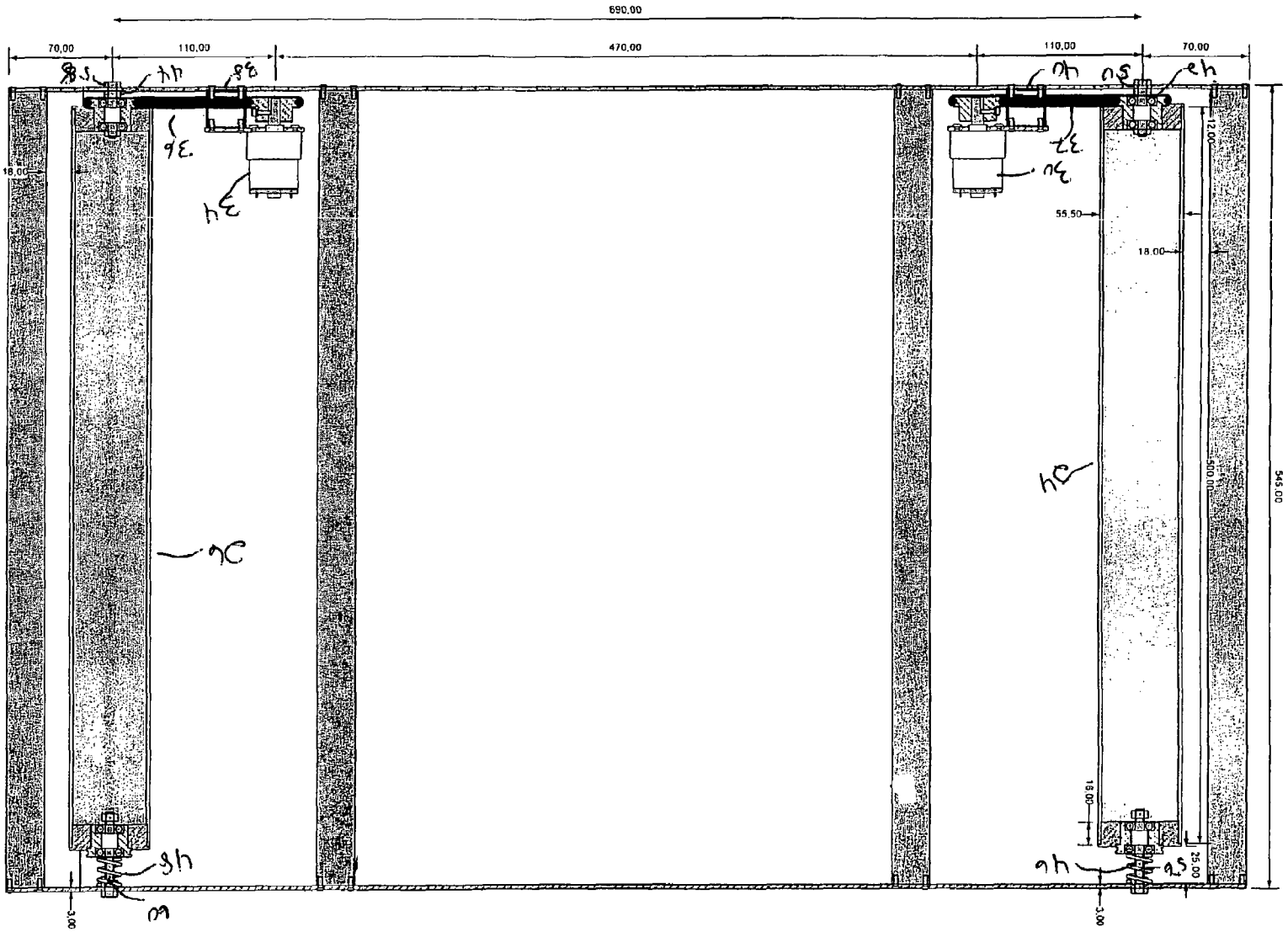
FIG. 3 is a schematic view of the scrolling sign housing shown in FIG. 2.

The scrolling sign housing 14 is shown in more detail in FIG. 3. One of the rotating tubes 24 onto which the advertising material or other indicia 16 would travel is affixed to the top and bottom of the scrolling sign housing 14. The rotating tube 24 must be affixed to the scrolling sign housing 14 in a manner allowing the tube 24 to rotate. For example, screw 50 would be attached to the bottom of the scrolling sign housing 14 attaching the rotating tube 24 to the bottom of the scrolling sign housing 14. A screw 46 would attach the tube 24 to the top portion of the scrolling sign housing 14. A spring 56 would bias the tube 24 in the position shown in FIG. 3. However, when the scrolling sign housing 14 is opened, the tube 24 onto which the advertising material or other indicia is rolled is forced downward, against the force of the spring 56, allowing the roll 24 to be removed from the housing. Similarly, tube 26 is affixed to the scrolling sign housing 14 through the use of a screw 58 affixed to the bottom of the housing as well as a screw 48 biased by spring 60 affixed to the top of the housing. This tube is removed in a manner similar to the removal of the tube 24.

Each of the tubes is driven by its respective motor 30, 34. Although the size and power of each motor is not important, it has been found that a 12 volt DC motor producing 200 rpms and powered by a 10 volt to 15 volt DC transformer would efficiently operate the present invention. However, other types of motors, AC or DC motors or stepper motors, can be used to operate the present invention. The motor 30 is connected to a bottom roller 42 of the tube 24 through the use of a belt, bar or other device 32 for causing rotation of the tube 24. It is noted that the motor 30 is secured within the scrolling sign housing 14 through the use of a support 40. Similarly, tube 26 is rotated through the use of motor 34. The motor 34 is connected to a roller 44 through the use of a belt, bar or other device 36 for rotating the tube 26. The same power source that would power the motor 34, namely, for example, a 10 volt to 15 volt DC transformer would also be used to power the motor 34. Additionally, a support 38 would be used to support the motor 34 within the scrolling sign housing 14.

Figure 4:
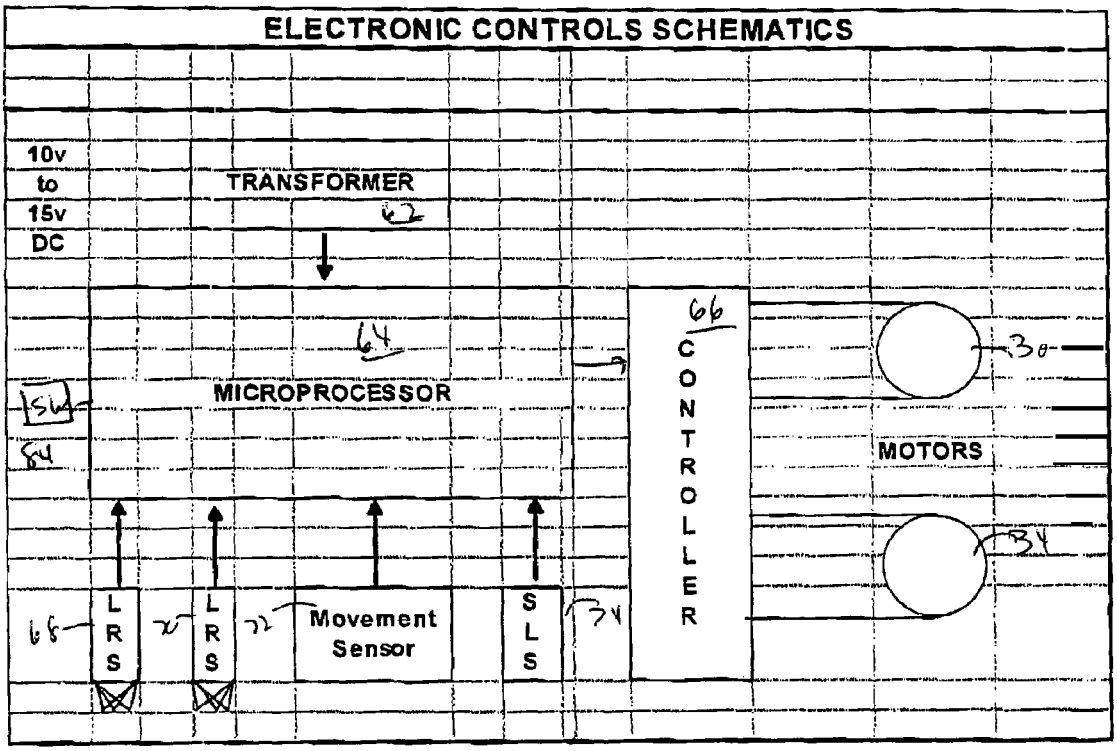
FIG. 4 is a block diagram showing the electronic controls for the present invention.

FIG. 4 illustrates the electronic controls used to supervise and operate the movement of the scrolled advertisement and indicia 18. A transformer 62 would be utilized to direct the vehicle's power supply, such as a standard battery, to operate the various sensing devices as will be described as well as to control the movement of the motors 30 and 34. The transformer 62 is connected to a standard microprocessor 64 programmed to operate the present invention, for controlling the operation of the present invention. This microprocessor has an integrated program to control the operation of the motors 30 and 34 through an electronic controller 66 based upon the sensing of various parameters of the vehicle 10.

One or more light reflection sensors (LRS) 68, 70 are used to detect specific markings on the moving scrolled advertisement or indicia panels 18. These sensors are used to determine the position of a graphic, or frame as well as the end of the path of the advertising material. A specific marking on the advertising material 18 would indicate a predetermined spot on the graphic material. A second marking would indicate the end of the path of that graphic material which will be utilized to reverse the movement of the graphic material. The specific marking on the graphic material is referenced at 80 and the marking indicating the end of the path of the graphic material is indicated at 82. The sensors 68 and 70 are generally located within the housing of the material 14 and are directed to a specific portion of the advertising material 18. Additionally, it is possible that the sensors 68 and 70 are located outside of the scrolling sign housing 14 at the side portion 28 of the housing.

A movement sensor 72 is used in conjunction with a stoplight sensor (SLS) 74 to determine various operational parameters of the vehicle 10. For example, these sensors would be utilized to determine whether the vehicle is rapidly moving, such as on a highway or other high speed thoroughfare or whether the vehicle is moving at a slower speed, indicative of city traffic. Additionally, both the movement sensor 72 and the SLS sensor 74 would be used to determine whether the vehicle is not moving or parked. The movement sensor 72 could operate by sensing the rotation of the vehicle's wheels or used in conjunction with the vehicle's speedometer. Furthermore, the SLS 74 could be used in conjunction with the vehicle's brake lights.

The electronic controller 66 receives information from the microprocessor 64 which in turn receives information from the various sensors 68, 70, 72 and 74. The controller 66 would then in turn operate the motors 30 and 34 consistent with a programmed sequence provided in the microprocessor 64 based upon the signals generated from the sensors 68, 70, 72 and 74.

The transformer 62 allows for the proper functioning of the equipment being powered from the vehicle's power generating source, allowing power variations at the source from 10 to 16 volts DC. If the vehicle's voltage descends below 11.5 volts, the operation of the scrolling sign is suspended to avoid further power drainage from the vehicle's battery. Once a voltage above 11.5 volts is detected, the scrolled advertising sign of the present invention would be reinitiated. It is noted that the transformer 62 could constantly supply the voltage from the vehicle's battery to the microprocessor 64 which would then in turn sense the value of the voltage and operate the invention accordingly. Alternatively, the transformer 62 would transmit a signal to the microprocessor 64 only when the voltage dips below 11.5 volts and then would transmit a second signal when the voltage exceeds 11.5 volts.

Furthermore, although it is noted that two motors 30 and 34 are employed to scroll the advertising material 18 in both the forward and backward directions, it is possible that only a single electric motor need be employed to allow the present invention to function.

The graphics and advertisements displayed on the vehicle 10 would conform to the laws of the area or areas in which the vehicle operates. In one embodiment, static images would be displayed which would span the entire viewing area of the scrolling sign housing 14 during a pre-programmed time frame. Under the control of the microprocessor 64, at the end of this time frame, the motors 30 and 34 would be engaged to move another display in place. Either based upon the time and movement of the motors, or through the utilization of the light reflection marking 80 on the surface of the display, the system would be able to insure that a proper display is in place. In a second embodiment, the scroll could be continually moved from a first start position to a second end position at a constant speed, allowing individual's to view the material on the display.

The present invention is designed to scroll the advertisement generally when the vehicle is traveling at a low speed, such as when it is in city traffic or when the vehicle is stopped. Therefore, the moving sensor 72 and the SLS 74, would operate the scrolled advertisement when it is sensed that the vehicle is in traffic. However, the movement of the display would stop when it is sensed that the vehicle is traveling at high speeds for a programmable period of time. Once it is sensed that the vehicle is in city traffic, the display device would be restarted.

If the vehicle is parked for a period of time, such as 15 minutes, the rotation of the graphics may or may not be suspended according to the position of a switch 84 which is mechanically connected to the microprocessor 64. This switch can be automatically or manually controlled. Furthermore, the present invention could be utilized with a light source directed toward the scrolling sign housing 14, such as back lighting which would be manually or automatically engaged.

It is to be understood that the above-described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A system for displaying graphical material on a moving vehicle, comprising:

a housing directly affixed to the moving vehicle;

a first moveable roller provided within said housing;

a sheet connected to said first movable roller, said sheet including graphical material thereon the speed of movement of said first moveable roller being independent of the speed of the moving vehicle;

a first motor provided within said housing and connected to said first roller for enabling said sheet, when activated, continuing to move in a first direction from one side of said housing to the second side of said housing;

a control device for operating said first motor to control the movement of said sheet in said first direction; and a sensing device for sensing the movement or speed of the vehicle, said sensing device producing an output signal transmitted to said control device for ceasing or activating the movement of said sheet based upon the the speed of the moving vehicle or the time the vehicle has not moved.

2. The system in accordance with claim 1 provided with a second movable roller provided within said housing, said sheet additionally connected to said second movable roller, and additionally provided with a second motor provided within said housing and connected to said second movable roller for enabling said sheet to move in said first direction, as well as in a second direction opposite to said first direction.

3. The system in accordance with claim 1, wherein said sensing device senses the speed of the vehicle and wherein said control device stops the movement of said sheet when the speed of said vehicle exceeds a predetermined speed for a predetermined period of time.

4. The system in accordance with claim 1, wherein said sensing device senses the time the vehicle has not moved and wherein said control device stops the movement of said sheet when the vehicle has not moved for a predetermined period of time.

5. The system in accordance with claim 3, wherein said sensing device senses the time the vehicle has not moved and wherein said control device stops the movement of said sheet when the vehicle has not moved for a predetermined period of time.

6. The system in accordance with claim 1, wherein said control device includes a microprocessor.

7. The system device in accordance with claim 3, further including a plurality of markings provided at discrete distances on said sheet as well as at least one sensor directed at the surface of said sheet to determine the position of said sheet, in conjunction with said plurality of markings.

8. The system device in accordance with claim 4, further including a plurality of markings provided at discrete distances on said sheet as well as at least one sensor directed at the surface of said sheet to determine the position of said sheet, in conjunction with said plurality of markings.

9. The system in accordance with claim 7, wherein one of said markings is provided proximate to the end of said sheet.

10. The system in accordance with claim 8, wherein one of said markings is provided proximate to the end of said sheet.

11. The system in accordance with claim 1, wherein said housing is affixed to an outside surface of the moving vehicle.

12. The system in accordance with claim 7, wherein two light reflection sensors are used to sense the position of said plurality of markings.

13. A method of displaying graphical material included on a sheet provided in a housing attached to a surface of a moving vehicle, comprising the steps of:

scrolling said sheet within said housing from a first side of said housing to a second side of said housing; and ceasing the scrolling of said sheet when the vehicle exceeds a predetermined speed for a predetermined period of time.

14. A method of displaying graphical material included on a sheet provided in a housing attached to a surface of a moving vehicle, comprising the steps of:

scrolling said sheet from a first side of said housing to a second side of said housing;

sensing the non-movement of the moving vehicle;

ceasing the scrolling of said sheet when the vehicle has not moved for a predetermined period of time.

15. The method in accordance with claim 13, further including the steps of restarting the scrolling of said sheet when the speed of the vehicle is below said predetermined speed for a predetermined period of time.

16. The method in accordance with claim 13, further including the steps of:

sensing the voltage of a battery provided in the vehicle supplying power for scrolling said sheet;

ceasing the scrolling of said sheet when the voltage of said battery is below a predetermined value.

17. The method in accordance with claim 16, further including the step of restarting the scrolling of said sheet when said predetermined value has been exceeded for a predetermined period of time.

18. The method in accordance with claim 13, including the step of restarting the scrolling of said sheet when the vehicle has begun moving.

19. The method in accordance with claim 13, further including the steps of:

sensing the voltage of a battery provided in the vehicle supplying power for scrolling said sheet; and ceasing the scrolling of said sheet when the voltage of said battery is below a predetermined value.

20. The method in accordance with claim 19, further including the step of restarting the scrolling of said sheet when said predetermined value has been exceeded for a predetermined period of time.

* * * * *